US006988855B2

(12) United States Patent
Fox et al.

(10) Patent No.: US 6,988,855 B2
(45) **Date of Patent: *Jan. 24, 2006**

(54) LATERAL DISPLACEMENT PIER AND METHOD OF INSTALLING THE SAME

(75) Inventors: Nathaniel S. Fox, Paradise Valley, AZ (US); Gale M. Peterson, Reinbeck, IA (US)

(73) Assignee: Geotechnical Reinforcement Company, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/772,756

(22) Filed: Feb. 5, 2004

(65) Prior Publication Data

US 2004/0170477 A1 Sep. 2, 2004

Related U.S. Application Data

(63) Continuation of application No. 10/178,676, filed on Jun. 24, 2002, now Pat. No. 6,688,815, which is a continuation of application No. 09/882,151, filed on Jun. 15, 2001, now Pat. No. 6,425,713.

(60) Provisional application No. 60/211,773, filed on Jun. 15, 2000.

(51) Int. Cl.
*E02D 5/30* (2006.01)
*E02D 5/34* (2006.01)
*E02D 7/18* (2006.01)

(52) U.S. Cl. ..... 405/232; 405/233; 405/240; 405/243; 175/23

(58) Field of Classification Search ..... 405/229, 405/231–233, 237–240, 243, 245, 248, 249, 405/251–253, 256, 257, 271; 175/57; 73/84, 73/784

See application file for complete search history.

(56) References Cited

U.S. PATENT DOCUMENTS

| | | | | | |
|---|---|---|---|---|---|
| 1,477,567 | A | * | 12/1923 | Lancaster | 405/243 |
| 1,501,643 | A | * | 7/1924 | Blumenthal et al. | 405/237 |
| 1,764,948 | A | * | 6/1930 | Frankignoul | 405/237 |
| 2,729,067 | A | * | 1/1956 | Patterson | 405/236 |
| 3,073,124 | A | * | 1/1963 | Nadal | 405/240 |
| 3,270,511 | A | * | 9/1966 | Colle | 405/237 |
| 3,638,433 | A | | 2/1972 | Sherard | 405/50 |
| 3,685,302 | A | | 8/1972 | Fuller | 405/237 |
| 3,869,003 | A | | 3/1975 | Yamada et al. | 175/171 |

(Continued)

FOREIGN PATENT DOCUMENTS

EP 079875 1/1986

(Continued)

OTHER PUBLICATIONS

Handbook of Concrete Engineering. Second Edition, edited by Mark Fintel, Van Nostrand Reinhold Company, New York, NY, 2nd Ed., Chap. 8, pp. 268-320, 1985.

(Continued)

*Primary Examiner*—Thomas B. Will
*Assistant Examiner*—Tara L. Mayo
(74) *Attorney, Agent, or Firm*—Banner & Witcoff, Ltd.

(57) ABSTRACT

Installation of support piers for a structure comprises the steps of positioning a hollow tube in a soil matrix followed by removal of soil from the hollow core, filling the core with an aggregate, subsequent raising and lowering of the hollow tube, compacting the aggregate by means of a mechanical device affixed to the bottom of the hollow tube to and also applying lateral forces to the aggregate against the walls of the cavity formed in the soil matrix, thereby pushing a portion of the aggregate laterally into the soil matrix.

6 Claims, 5 Drawing Sheets

U.S. PATENT DOCUMENTS

| | | | | | |
|---|---|---|---|---|---|
| 3,960,008 | A | * | 6/1976 | Goble et al. | 73/84 |
| 3,975,917 | A | * | 8/1976 | Asayama | 405/232 |
| 4,165,198 | A | | 8/1979 | Farmer | 405/243 |
| 4,230,425 | A | * | 10/1980 | Gusev et al. | 405/239 |
| 4,314,615 | A | | 2/1982 | Sodder, Jr. et al. | 175/94 |
| 4,605,339 | A | | 8/1986 | Bullivant | 405/237 |
| 4,637,758 | A | | 1/1987 | Tamaki et al. | 405/248 |
| 4,657,441 | A | | 4/1987 | Horvath | 405/254 |
| 4,730,954 | A | | 3/1988 | Sliwinski et al. | 405/240 |
| 4,738,568 | A | | 4/1988 | Steding | 405/241 |
| 4,770,256 | A | | 9/1988 | Lipsker et al. | 175/57 |
| 4,966,498 | A | | 10/1990 | Blum | 405/233 |
| 5,066,168 | A | | 11/1991 | Holdeman | 405/249 |
| 5,181,797 | A | * | 1/1993 | Circeo et al. | 405/131 |
| 5,249,892 | A | * | 10/1993 | Fox et al. | 405/233 |
| 5,423,633 | A | | 6/1995 | Verstraeten | 405/228 |
| 5,608,169 | A | | 3/1997 | Fujioka et al. | 73/803 |
| 5,622,453 | A | | 4/1997 | Finley et al. | 405/240 |
| RE35,715 | E | * | 1/1998 | Circeo et al. | 588/253 |
| 5,978,749 | A | | 11/1999 | Likins, Jr. et al. | 702/158 |

FOREIGN PATENT DOCUMENTS

| | | |
|---|---|---|
| SU | 649789 | 5/1979 |
| WO | WO 1994/023135 | 10/1994 |

OTHER PUBLICATIONS

International Preliminary Examination for PCT/US00/01794 dated Jul. 23, 2001.

International Search Report for PCT/US00/01794 dated Jun. 6, 2000.

International Search Report for PCT/US01/19214 dated Nov. 5, 2001.

J.E. Bowles, Foundation Analysis and Design, 4th Ed., Chap. 8, pp. 288-303.

Lawton, et al., Control of Settlement and Uplift of Structures using Short Aggregate Piers, ASCE National Convention, Oct. 9-13, 1994, pp. 121-132.

ENR Engineering News-Record, the Construction Weekly, Shorter Piles Have Deep Impact, Jul. 1996.

* cited by examiner

LATERAL DISPLACEMENT PIER AND METHOD OF INSTALLING THE SAME

CROSS REFERENCE TO RELATED APPLICATION

This is a continuation utility application based upon continuation utility application Ser. No. 10/178,676 (now U.S. Pat. No. 6,688,815) filed Jun. 24, 2002 entitled "Lateral Displacement Pier and Method of Installing the Same", which is based upon parent application Ser. No. 09/882,151 (now U.S. Pat. No. 6,425,713 B2) filed Jun. 15, 2001 entitled "Lateral Displacement Pier and Method of Installing the Same", which is based upon provisional application Ser. No. 60/211,773, filed Jun. 15, 2000 entitled "Displaced Aggregate Pier", all of which priority is claimed and which are incorporated herewith by reference.

BACKGROUND OF THE INVENTION

In a principal aspect the present invention relates to a pier construction for supporting structures in a soil matrix wherein the pier is formed with a special mechanical apparatus from an aggregate material by compacting successive lifts or sectors of the aggregate material located in a cavity in the matrix.

In U.S. Pat. No. 5,249,892, incorporated herewith by reference, a method and apparatus are disclosed for producing short aggregate piers in situ. The process includes forming a cavity in soil and then introducing successive layers of compacted aggregate material into the cavity to form a pier that can support a structure. The aggregate may be comprised of various materials. The lifts or layers of aggregate which are compacted during the pier forming process typically have a diameter of 1 to 3 feet and a vertical rise of similar dimension and range. Thus, such piers are made by drilling a hole or cavity in a soil matrix, placing aggregate or other select fill material in small discreet layers in the cavity, and then tamping each layer of the material in the cavity with a special mechanical tamper apparatus to provide impact or ramming energy to the layer of material. This apparatus and process produces a stiff and effective stabilizing element or pier. However, this method of pier construction has a limitation in terms of the depth to which the pier forming process can be accomplished economically. Typically the process described in the patent is limited to a depth of approximately 20 feet because of the equipment utilized, the time required to make a pier and the techniques that are available. Thus, there has developed a need for a mechanical apparatus, as well as a construction process, which can be successfully and economically utilized at greater depths yet have the attributes and benefits associated with the short aggregate pier method, apparatus and construction disclosed in U.S. Pat. No. 5,249,892.

SUMMARY OF THE INVENTION

Briefly, the present invention comprises a method for installation of a pier formed from layers of aggregate material in a soil matrix and includes the steps of positioning a hollow tube with a special mechanical bottom compacting apparatus in the soil matrix, removing the soil matrix from the core of the tube and the special mechanical bottom compacting apparatus followed by at least partially filling the tube and the special mechanical compacting apparatus with an aggregate material and then raising and lowering the tube and bottom apparatus within the soil matrix as the tube and bottom apparatus are incrementally raised in steps from the cavity. Raising and lowering of the tube and bottom apparatus enables a specially designed lower portion of the bottom apparatus to impact upon the aggregate material, thereby densifying the material, forcing the material laterally outward and simultaneously imparting lateral forces on the aggregate and the soil matrix and applying longitudinal forces on the aggregate. The tube with bottom apparatus may be vibrated while being incrementally raised and lowered depending upon conditions of the soil matrix and composition of the aggregate materials. The tube with bottom apparatus may also be pushed downward or driven downward during the "lowering" sequence to provide additional densification and lateral force energy. In this manner, compacted lifts are incrementally formed by the bottom apparatus as the tube is removed from the cavity in the soil matrix. The process is continuously repeated along the length of the soil cavity with a result that an elongate pier of separately compacted layers or lifts is formed within the soil matrix. A pier having a length or depth of fifty (50) feet or more can be constructed in this manner.

Numerous types of aggregate materials may be utilized in the practice of the process including a mixture of aggregate and dry cement. Such mixture has proven to be beneficial in creating a pier having significantly improved stiffness and integrity for support of a structure, especially when the soil matrix is very soft and weak.

The tube with bottom mechanical apparatus may be positioned within the soil matrix in the event the soil is soft by forcing the tube into the soil matrix with or without applying vibration energy. If the soil is hard, the soil matrix may be pre-drilled to form a cavity into which the tube apparatus is lowered or driven prior to filling the tube with aggregate. In any event, the soil contained within the hollow tube apparatus is removed from the tube apparatus once the tube apparatus is lowered, pushed, vibrated, driven or otherwise placed in the soil. A drill or other evacuation technique is used to remove the soil from the interior of the hollow tube apparatus. In soft soils, a removable cap or a sacrificial cap may be placed at the bottom of the hollow tube apparatus to prevent soil matrix from entering the tube. For such situations, removal of the soil matrix from within the hollow tube will not be necessary. Other steps described in the process of making the lateral displacement pier remain essentially the same. Other mechanical apparatus descriptions contained herein remain essentially the same.

In a preferred embodiment, the lower portion of the tube apparatus is designed with an inwardly extending bevel so that both lateral and longitudinal forces may be imparted to aggregate in the tube by the downward movement of the tube apparatus within the soil matrix cavity during incremental raisings and lowerings. The bevel may be effected by an internal thickening of material formed at the lower end of the tube apparatus. In that event, the drill or auger for removing the soil from the tube apparatus may have a special construction including reduced diameter section at the distal end of the drill or auger. The bevel may also be effected by an external thickening of material formed at the lower end of the tube apparatus. The bevel may also be effected by a combination of an internal thickening and an external thickening of material formed at the lower end of the tube apparatus.

During the practice of the method, the aggregate will be compacted and thus additional aggregate will necessarily be added to the tube apparatus as the aggregate is densified and compacted. Upon completion of the formation of the pier and total removal of the hollow tube apparatus from the soil matrix, the pier may be pre-loaded, for example, by placement of a static or dynamic load thereon, prior to placing a structure on the pier. This preloading process will stiffen the constructed aggregate pier and will cause prestressing and prestraining of the matrix soil in the vicinity of the pier, thus increasing the support capacity of the pier.

Thus, it is an object of the invention to provide a special hollow tube apparatus with a special designed bottom apparatus portion to create a compacted aggregate pier that extends to a greater depth and to provide an improved method for creating a pier that extends to a greater depth than typically enabled or practiced by prior short aggregate pier technology.

It is a further object of the invention to provide a method or process for installing a pier formed of aggregate material wherein the material has discrete compacted lifts along the length of the pier with the hollow tube apparatus and special designed bottom apparatus.

Yet a further object of the invention is to provide a method for forming an elongate pier having improved load bearing characteristics when incorporated in the soil matrix wherein the pier is formed of a compacted aggregate material and the compaction is effected by a hollow tube apparatus and special designed bottom apparatus which is placed within a soil cavity filled with the aggregate and may be vibrated, pushed downward, driven downward, or a combination of these.

Yet another object of the invention is to provide an improved method for forming a pier of aggregate material wherein the aggregate may be chosen from a multiplicity of options, including a mix of stone or other types of aggregate with dry cement.

Yet a further object of the invention is to provide an aggregate pier construction which is capable of being incorporated in many types of soil and which is further capable of being formed at greater depths than prior aggregate pier constructions.

These and other objects, advantages and features of the invention will be set forth in the detailed description which follows.

BRIEF DESCRIPTION OF THE DRAWING

In the detailed description which follows reference will be made to the drawing comprised of the following figures.

DESCRIPTION OF THE PREFERRED EMBODIMENT

Figure 1:
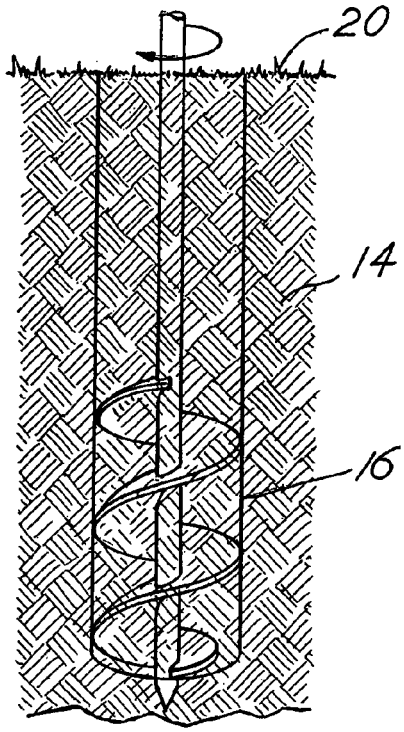
FIG. 1 is a schematic cross sectional view of a first step in the process of the invention.

FIGS. 1–7 illustrate the sequential steps in the performance of the method of the invention and the resultant pier construction. Referring to FIG. 1, the method is applicable to placement of piers and supports for structures in a soil matrix 14 which requires reinforcement. A wide variety of soils may require the practice of the invention. With the invention it is possible to provide a pier of aggregate material having greater stiffness and structural integrity than some prior art aggregate piers and which can extend to greater depths than some prior art aggregate piers thus enabling support thereon of more massive and more weighty structures.

Figure 2:
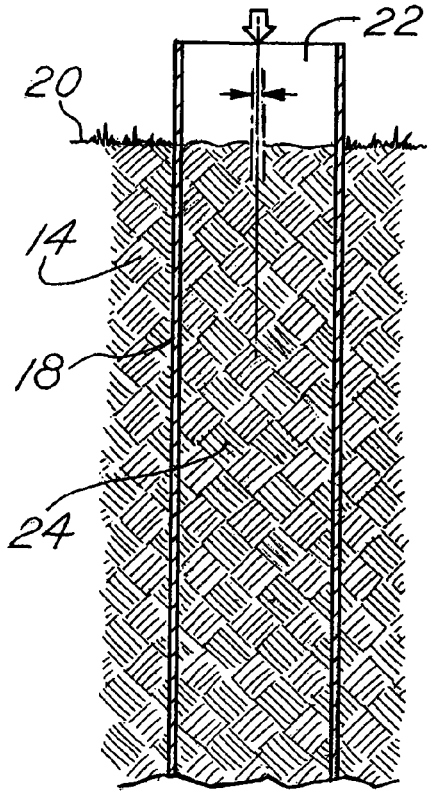
FIG. 2 is a schematic cross sectional view of a further step in the process of the invention.

As a first step, a cavity or hole 16 is drilled in the soil matrix 14. It is unnecessary, however, to remove the loose soil 14 from the cavity. Rather, by predrilling the hole to a desired depth, for example, 50 feet, the soil 14 within the cavity is loosened so that a casing 18 may be inserted or driven into the cavity 16. As shown in FIG. 2, the hollow tube apparatus 18 may comprise a cylindrical steel tube having a diameter, for example, in the range of 24–36 inches. In the event that the soil 14 has been predrilled in order to soften or agitate the soil 14, the casing 18 can be vibrated as it is lowered into the drilled cavity 16. Alternatively, it is possible to remove the soil 14 during the drilling operation and then place the hollow tube apparatus 18 within the generally hollow cavity. As a further alternative, in the event the soil 14 is adequately soft, the hollow tube apparatus may be driven or pushed or vibrated, or a combination of these, into the soil 14 to the desired depth without predrilling or otherwise loosening the soil 14. The character of the soil 14 matrix will thus dictate, at least in part, the particular procedure adopted.

Typically, the hollow tube apparatus 18 is cylindrical although other shapes may be utilized. Typically, the diameter of the hollow tube apparatus is 24–36 inches, although other diameters may be utilized in the practice of the invention. Also typically, the hollow tube apparatus 18 will extend to the ultimate depth of the pier or within 36 inches or less of the ultimate depth of the pier. A portion of the hollow tube apparatus 18 will typically extend above the gradient or plane 20 of the soil matrix 14 as depicted in FIG. 2. This enables the hollow tube apparatus 18 to provide a top opening 22 which may be engaged or gripped to vibrate the hollow tube apparatus 18 and which may also serve as an inlet spout to the interior or hollow core 24 of the hollow tube apparatus 18.

Figure 3:
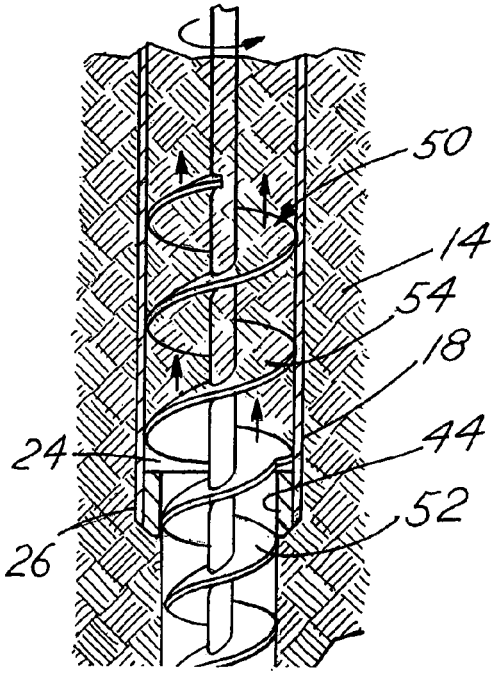
FIG. 3 is a schematic view of further step in the process of the invention.

FIG. 3 illustrates a further step in the practice of the invention. The soil 14 within the hollow core 24 of the tube apparatus 18 is removed after the tube apparatus 18 is positioned in soil 14. As shown in FIG. 3, an auger 50 may be inserted within the hollow tube apparatus 18 to remove soil 14 from the hollow tube apparatus 18. Typically, the auger 50 will remove the soil 14 only from the entire core or interior 24 of the hollow tube apparatus 18. However, in circumstances such as depicted in FIG. 3, the auger 50 may project below the lower end 26 of the hollow tube apparatus 18 to remove soil 14 from the region below the hollow tube apparatus 18. Additionally, in the event the hollow tube apparatus 18 includes a rim construction described below, auger 50 may have a special construction including a reduced diameter blade as depicted in FIG. 3 and as further discussed below, to remove loose soil 14 from beneath the hollow tube apparatus 18.

Figure 4:
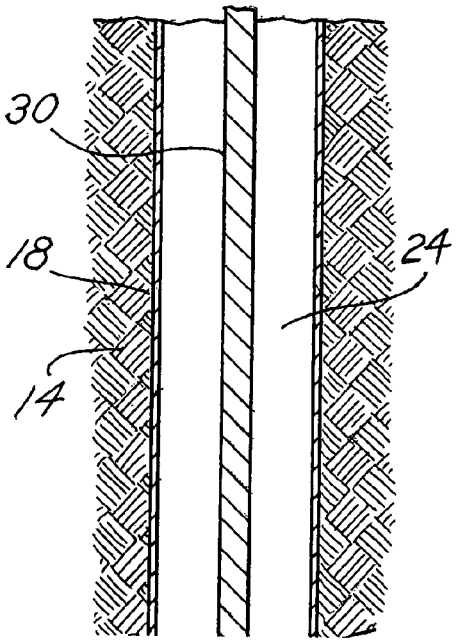
FIG. 4 is a depiction in a schematic cross sectional view of a further step in the practice of the invention.
Figure 9:
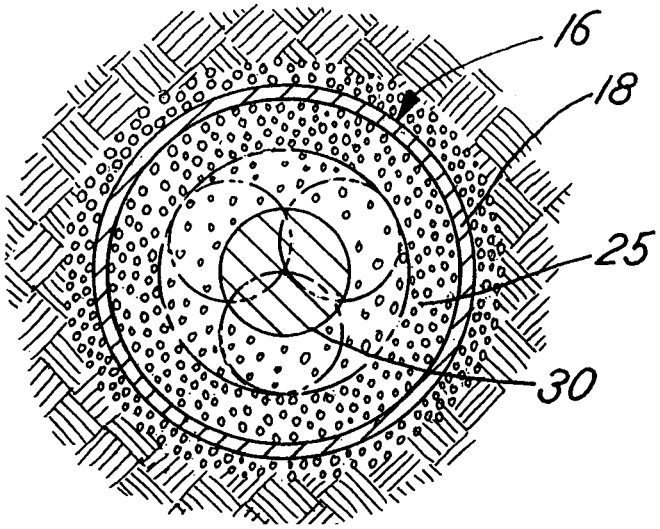
FIG. 9 is a cross sectional view of the hollow tube apparatus of FIG. 7 along the line 9—9 as positioned in a soil matrix incorporating an element which is used to help assist in densifying the aggregate within the hollow tube apparatus.

FIG. 4 represents a subsequent sequential step in the practice of the invention. The step of FIG. 4 is optional and may or may not be included depending upon the size or diameter of the hollow tube apparatus 18, the depth of the hollow tube apparatus 18 in the soil matrix 14 and the aggregate or material which is used in the formation of the pier. As depicted in FIG. 4, an element 30 is positioned generally axially within the hollow tube apparatus 18. The element 30 may have any desired cross sectional shape including a rod type shape or an I-beam shape. The element 30, however, must be positioned and located so that it can be vibrated. In a preferred embodiment, the element 30 extends the entire longitudinal depth of the hollow tube apparatus 18 within the soil matrix 14 although it may extend for a lesser depth if so desired. FIG. 9 illustrates, in cross sectional view, the element 30 and its operation as described below in more detail.

Figure 5:
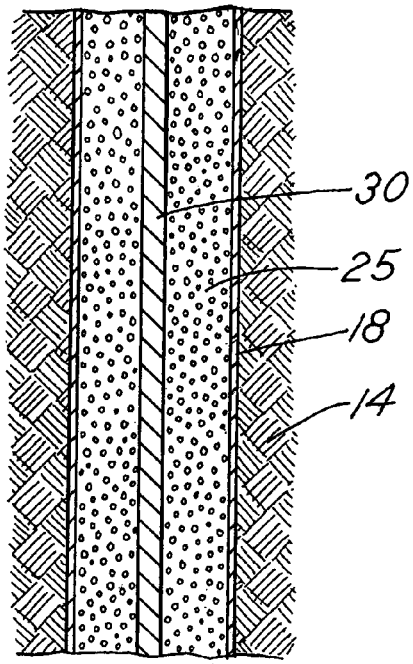
FIG. 5 is a schematic view of another step in the process of the invention.

Next, referring to FIG. 5, aggregate material 25 is filled into the hollow core 24 of the tube apparatus 18. The aggregate 25 is preferably clean stone material. An alternative aggregate 25 comprises clean stone without fines or graded stone with fines, and with dry cement. The combination of dry cement and stone has been found to be especially advantageous and preferable in the practice of the invention under certain soil matrix conditions such as very soft and weak soils. Note, however, that many alternative choices exist with respect to the material used as an aggregate 25. Aggregate 25 should therefore be interpreted broadly to include various materials and mixtures including stone, recycled concrete, recycled asphalt, sand, chemical additives, other additives and materials including mesh materials, and mixtures thereof. The aggregate 25 typically, however, does not include viscous concrete, i.e, a slurry that is mixed, cured and then hardens. Rather, the aggregate 25 comprises separate particulate matter including multiple types of particulate and additives thereto all of which are compacted in layers in the process of forming the pier of the invention. The physically compacted materials are compressed longitudinally in the direction of the hollow tube apparatus 18 inserted into the soil matrix and forced laterally to engage and displace the sides of the soil matrix 14.

As shown in FIG. 5, the optional element 30 is surrounded by the aggregate 25 which is placed in the hollow tube apparatus 18. Typically, the aggregate 25 is filled to the top of the hollow tube apparatus 18 and as the aggregate material 18 is compacted, it may be necessary to add additional aggregate 25 to the hollow tube apparatus 18. Also, it is possible that various types of aggregate 25 may be provided in various sections along the length of the casing. For example, dry stone material having a certain drainage gradation may be provided at the lower end of the pier within the hollow tube apparatus 18. Thereafter, a mixture of stone and dry cement may be provided with ad-mixtures of chemicals, mesh materials and the like. Thus, the hollow tube apparatus 18 may include various alternative types of aggregate 25 along the length or depth of the formed cavity 18.

Figure 6:
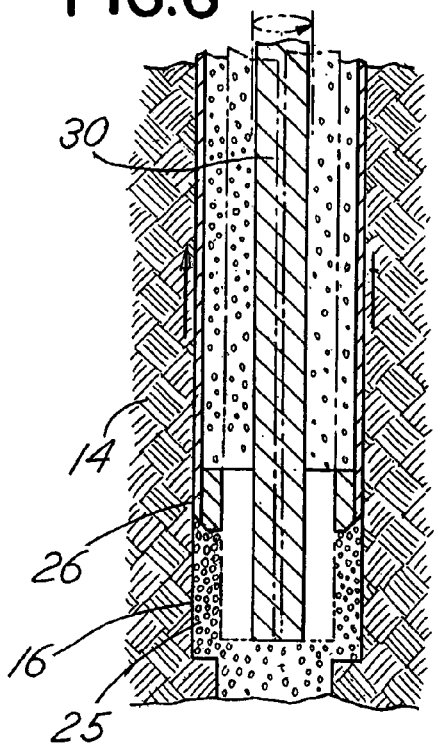
FIG. 6 schematically depicts a further step in the practice of the invention.

The next step schematically shown in FIG. 6 involves vibration of the insert element 30 and/or the hollow tube apparatus 18, or both. As mentioned above, the insert element 30 is an optional element. Vibration of the element 30 will cause densification and settling of the aggregate material. This lateral vibration process is graphically illustrated in greater detail in FIG. 9 with typical vibration positions illustrated in phantom. The element 30 is depicted in a cross sectional view in FIG. 9 and vibrates or oscillates from side to side as well as longitudinally or lengthwise (FIGS. 6 and 7), or both, within the hollow tube apparatus 18.

The element 30 may be retained within the hollow tube apparatus 18 preferably initially axially aligned with the centerline axis of the apparatus 18. As the hollow tube apparatus 18 is withdrawn, element 30 is caused to oscillate or vibrate and further transfer and compact and densify the aggregate material 25. Alternatively, the element 30 may be vibrated and then removed from the hollow tube apparatus 18 prior to initial upward movement of the hollow tube apparatus 18 within the soil cavity 14. Also, the assembly of the element 30 and the hollow tube apparatus 18 may be simultaneously vibrated and removed from the soil 14. All of these possibilities are available depending upon the soil 14, the aggregate material 25, the depth of the pier, the lateral width of the pier and other parameters. A choice can thus be made as to the most appropriate alternative for the particular construction project. The element 30 is, of course, optional or alternative in the method and practice of the invention.

Figure 7:
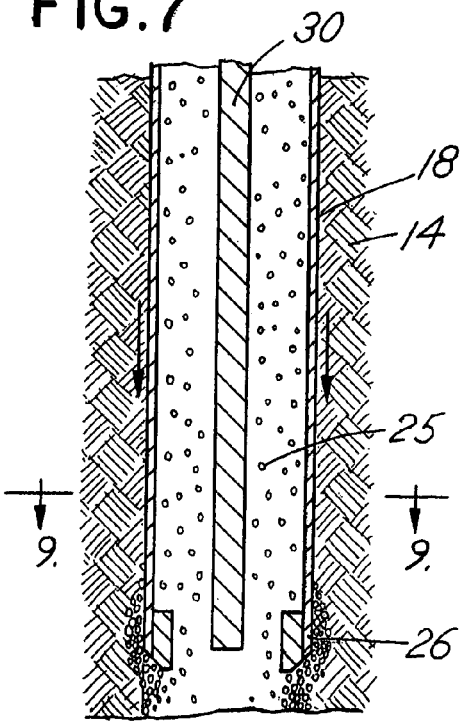
FIG. 7 is an enlarged schematic cross sectional view of the special mechanical compacting apparatus which is used in the practice of the invention.
Figure 8:
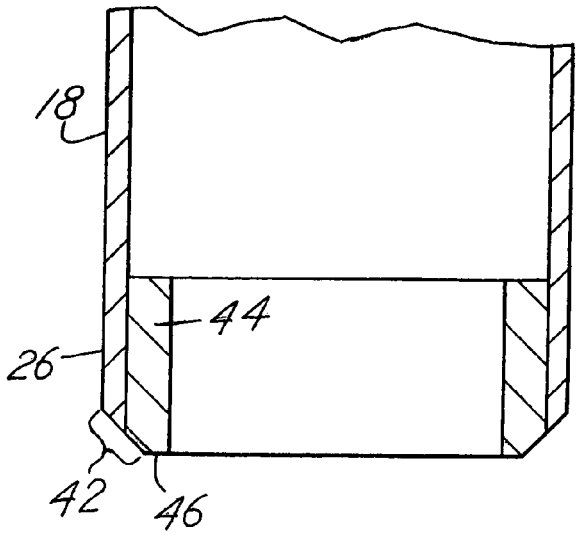
FIG. 8 is a cross sectional view of the active end of the hollow tube apparatus.
Figure 14:
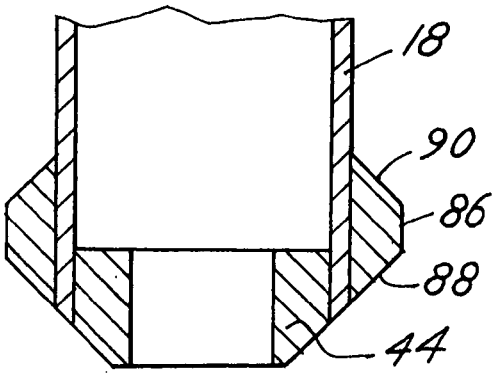
FIG. 14 is an enlarged cross sectional view of an alternative embodiment of the mechanical apparatus utilized in the practice of the invention.

Referring next to FIG. 7, the element 30 may be vibrated and removed and subsequently the hollow tube apparatus 18 may be vibrated both laterally and longitudinally. Typically, however, the casing (hollow tube apparatus) 18 is vibrated longitudinally. As depicted in FIG. 8, the lower portion 26 of the hollow tube apparatus 18 has a preferred mechanical shape or configuration. Specifically, the lower end 26 of the hollow tube apparatus 18 has a thickened ring portion with an inwardly beveled configuration defined by inwardly beveled surface 42. The inwardly beveled surface 42 formed in the lower end 26 of the hollow tube apparatus 18 includes a rim member 44 welded or otherwise attached to the inside of the hollow tube apparatus 18. Although the preferred method is to have the rim member permanently attached to the hollow tube apparatus, an option in that the rim member may be temporarily affixed to the hollow tube apparatus. A rim member 44 extends around the entire, interior circumference of the hollow tube apparatus 18. The rim member may also extend around the entire, exterior circumference of the hollow tube apparatus as shown in FIG. 14. Alternatively, rim members may extend around the entire internal and the entire external circumference of the hollow tube apparatus as also shown in FIG. 14. In all cases, an inwardly beveled surface is created by the rim member, or by the rim member and the tube bottom itself, whether the rim member extends around the interior circumference, the exterior circumference, or both the interior and the exterior circumference of the hollow tube apparatus.

Figure 10:
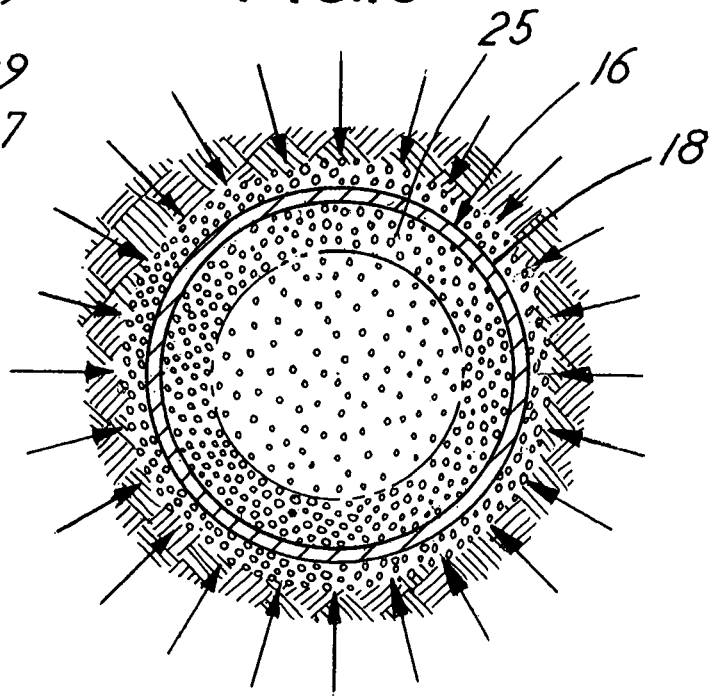
FIG. 10 is a cross sectional view of the hollow tube apparatus and aggregate similar to FIG. 9 wherein the element 30 has been removed.

The rim member 44 defines a portion of surface 42 which, when the hollow tube apparatus 18 is vibrated, effects transfer of energy from the surface 42 to the aggregate material 25 and ultimately the surrounding matrix soil 14. Thus, as the hollow tube apparatus 18 typically vibrates longitudinally or up and down in the figures causing, the surface 42 to impart a lateral vector force against aggregate material 25 as well as the soil 14 matrix as diagramatically depicted in FIG. 10. Another vector force will simultaneously be imparted downwardly on the aggregate material 25. The magnitude of the respective vector forces is dependent upon the angle of the bevel 42 as well as the frequency and amplitude of the vibration and the surface area of the beveled surface 42. Additionally, the surface 42 may connect to a transverse surface 46 of rim 44 which will impart forces in the longitudinal direction on the aggregate material 25. The design of these surfaces 42, 26 and their extent thus become an important feature of the invention. Typically, for example, a hollow tube apparatus having a diameter of 30 inches will include an interior rim member 44 having a wall thickness of 1 to 1½ inches. That, in combination with the wall thickness of the hollow tube apparatus 18 will provide a total wall thickness of approximately 2 to 2½ inches. Such a wall will have a bevel surface 42 and a lower impact surface 46. The bevel surface 42 will typically form an angle of 45 degrees within casing 18 axis though the angle may be varied, preferably in the range of between 15 and 75 degrees from horizontal as depicted in FIG. 8.

In practice, the hollow tube apparatus 18 will be located at a fixed depth in cavity 16 and vibrated at a certain position within the cavity 16. The hollow tube apparatus 18 will then be moved upwardly a certain distance equivalent, for example, to twice the height of a completed lift, e.g. about 24 inches. Lowering of the hollow tube apparatus, with or without vibration, will then cause impaction of material 25 once again. In this manner, a series of lifts along the length of the pier will be formed. Each lift will comprise a compacted material resulting in lift elements having a general configuration of the type depicted and described in U.S. Pat. No. 5,249,892, although bulging may not be as pronounced and interior portions of the pier may not be as densified as with the short aggregate pier described in U.S. Pat. No. 5,249,892. The elements, however, are formed in a manner that does not utilize a separate tamping tool. Rather, the hollow tube apparatus with special mechanically designed bottom portion 18 acts as a tamping mechanism and also as a vibrating mechanism, and the alternative vibrating element 30 further facilitates densification and tamping. The element 30 may also act as a tamping device when employed.

Figure 11:
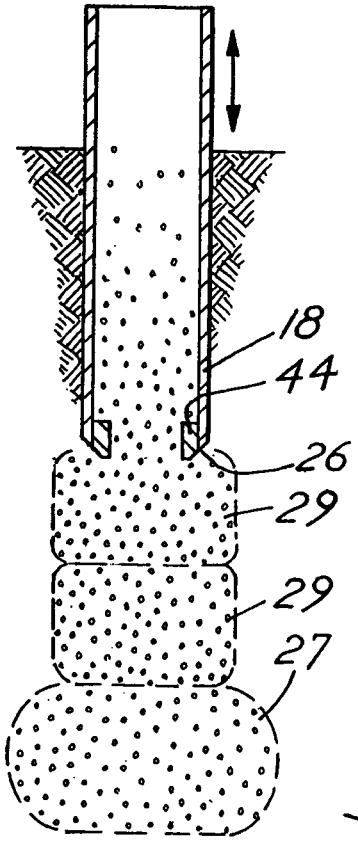
FIG. 11 is a cross sectional view of a partially formed pier by the special mechanical compacting apparatus and the disclosed process.

With the hollow tube apparatus 18 configuration depicted in FIG. 8, an auger 50 as shown in FIG. 3 may be utilized to remove the original soil 14 from the hollow tube apparatus 18. The auger 50 may include a reduced diameter blade 52 which will fit through the region incorporating the thickened mechanical rim 44 so that soil matrix 14 can be removed from beneath the end 26 of the hollow tube apparatus 18. In this manner, when aggregate 25 is placed within the hollow tube apparatus 18, it will initially form a bulb 27 in a compressed region of material 25 beneath the end 26 of the hollow tube apparatus 18 as depicted in FIG. 11. The auger 50 further includes an increased diameter blade section 54 for evacuation of the interior or core of the hollow tube apparatus 18.

The element 30 may also constitute a hollow tube with an end formed in the manner depicted in FIG. 8. Thus, both the hollow tube apparatus 18 as well as the element 30 may receive and feed aggregate into the soil cavity and act to form and tamp the material 14 and form the respective lifts as the element 30 and hollow tube apparatus 18 are alternately lifted vertically and lowered with or without vibration, and with or without pushing or driving energy applied as described.

Although the movement of the hollow tube apparatus 18 and the optional element 30 is described to be performed in incremental and generally equal steps, it is possible to vary the amount of movement of the hollow tube apparatus 18 and element 30 during each of the separate steps of longitudinal movement. Movement may also be simultaneous or non-simultaneous. Also, the direction, amplitude and frequency of vibration may be varied depending upon the material forming the aggregate pier and other factors. Also, the application of downward pushing energy or driving energy may be varied or may be omitted depending upon the material forming the aggregate pier and other factors. In any event, successive lifts 29 are formed as depicted in FIG. 11.

Further, the aggregate may contain fluid materials or chemicals or the hollow tube apparatus 18 may be coated to facilitate aggregate flow and compaction. The hollow tube apparatus 18 may be precoated or fluids added during the vibration steps or otherwise as discussed hereinafter.

The process and resulting product piers or columns were built and tested in comparison to prior art stone columns. Two lateral displacement piers and one stone column pier were installed in May, 2001 on the same site and in similar soil conditions. Each of these three piers was of the same diameter and each was of the same length. The two lateral displacement piers were each constructed with a different apparatus, one with an outward-facing bevel at the bottom side wall and a thickened bottom apparatus attached to a hollow tube apparatus. The other lateral displacement pier was constructed with the hollow tube apparatus extending full length, and without the beveled thickened bottom apparatus portion with the outward-facing beveled bottom.

Figure 12:
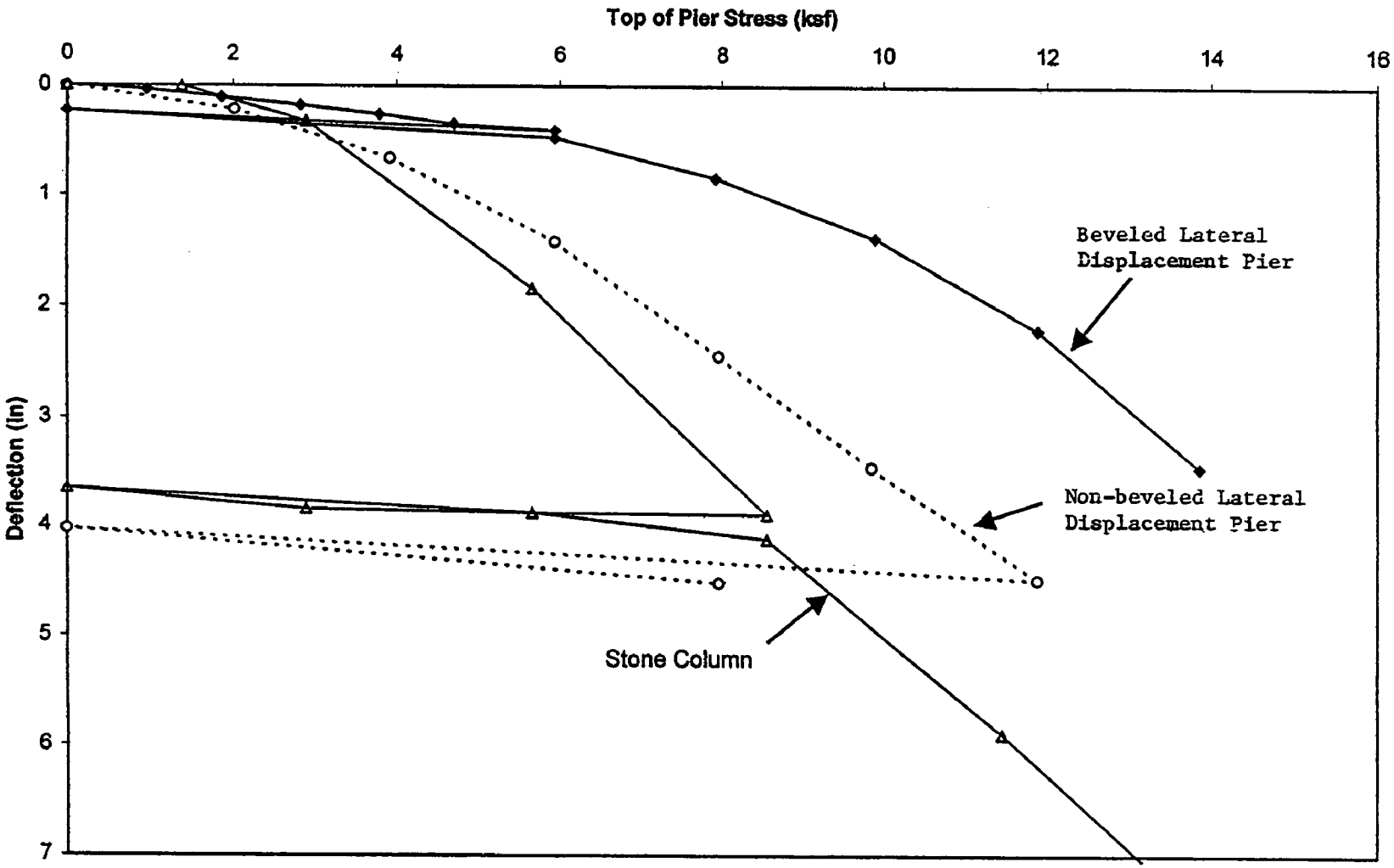
FIG. 12 is a graph illustrating the comparative load testing of piers of the present invention as compared with various prior art constructions.

The two lateral displacement piers were load tested using a circular plate and reaction beams to apply vertical compressive loads in increments. Load deflection readings were made of each pier, and the load deflection curves were plotted and are shown on FIG. 12. Stiffness Modulus values were determined by dividing the stress values at top of pier by the corresponding pier movements (deflections). A similar load test was performed of the stone column pier. Results of that load test are also shown on FIG. 12.

Deflections corresponding to top of pier stresses of 6,000, 8,00, 10,000, and 12,000 psf are shown on Table 1. Modulus values corresponding to the same top of pier stress are also shown on Table 1. Ratios of modulus values produced by the beveled lateral displacement pier to modulus values produced by the non-beveled lateral displacement pier are shown on Table 1, as well as ratios of the beveled lateral displacement pier modulus values to those of the stone column.

It can readily be seen that stiffness modulus values produced by the beveled lateral displacement pier are significantly greater than those of the non-beveled lateral displacement pier. For example, within the 6,000 to 8,000 psf top of pier stress range, modulus values of the beveled pier are about 3 times greater. It is further shown that stiffness modulus values of the beveled lateral displacement pier are significantly greater than the stone column pier. For the 6,000 to 8,000 psf top of pier stress range, modulus values of the beveled lateral displacement pier are about 4 times greater than those of the stone column pier.

The beveled lateral displacement pier produced stiffer elements than the other two piers. Deflections corresponding to applied to of pier stresses were less than corresponding deflections of the non-beveled and non-thickened hollow tube apparatus pier, and even greater differences were measured in comparing the beveled lateral displacement pier with the stone column pier.

Table 1 reports the observed results.

TABLE 1

| | Top of Pier Stress | | | |
|---|---|---|---|---|
| | 6,000 psf | 8,000 psf | 10,000 psf | 12,000 psf |
| 1. Deflections, inches | | | | |
| Beveled Lateral Displacement Pier (LDP) | 0.50 | 0.86 | 1.43 | 2.29 |
| Non-Beveled LDP | 1.48 | 2.48 | 3.52 | 4.57 |
| Stone Column | 2.10 | 3.48 | 5.02 | 6.26 |
| 2. Modulus Values, pci | | | | |
| Beveled LDP | 83.3 | 64.6 | 48.6 | 36.4 |
| Non-Beveled LDP | 28.2 | 22.4 | 19.7 | 18.2 |
| Stone Column | 19.8 | 16.0 | 13.8 | 13.3 |
| 3. Ratio of Modulus Values | | | | |
| Beveled LDP | 3.0 | 2.9 | 2.5 | 2.0 |
| Non-Beveled LDP | | | | |
| Stone Column | 4.2 | 4.0 | 3.5 | 2.7 |

Figure 13:
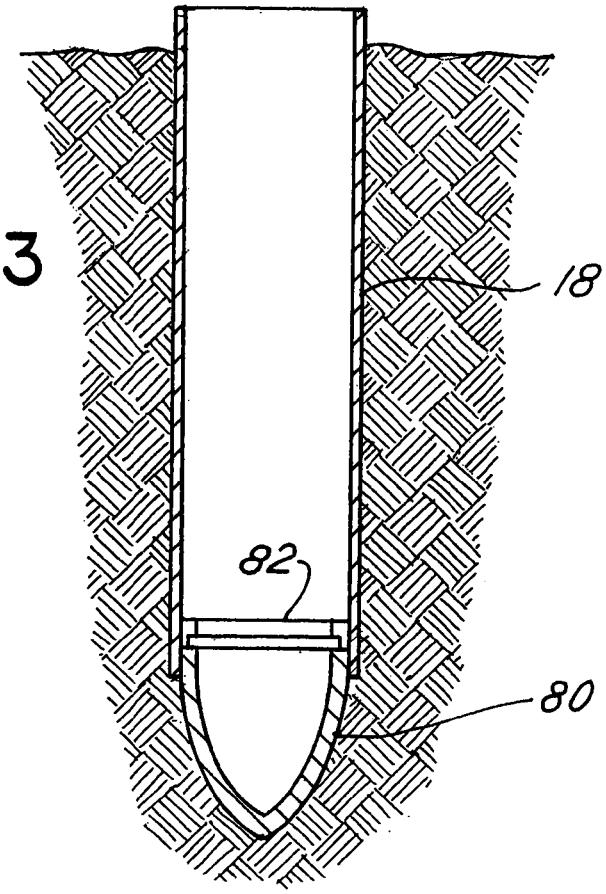
FIG. 13 is a cross sectional view of an alternative embodiment and method for the practice of the invention.

Additional embodiments and variations of the invention, including the method of the invention and the apparatus for practice of such methods, are contemplated. Referring to FIG. 13, an alternative embodiment is depicted as well as an alternative method of practice of the invention. In particular, a casing 18 is provided with an end cap 80. In the embodiment depicted, the end cap 80 has a pointed configuration and is held in place on the casing by means of a removable lock ring 82. The lock ring 82 may be rotated, for example, to release the cap 80 for removal of the cap 80 upon the desired depth of penetration of casing 18 into a soil matrix. Alternatively, the cap 80 may be left in position within the ground or soil matrix by merely releasing the cap retaining ring 82.

In any event, the apparatus of FIG. 13 is provided to close the hollow tube in order to keep soil from entering the tube or casing 18 as it penetrates the soil matrix. The casing or hollow tube 18 can then be driven, vibrated, pushed or manipulated by a combination of the described methods to assume a desired depth in the soil matrix. The bottom cap 82 may then be left in place or removed through the hollow tube. The column or pier is then constructed in the manner previously described. The bottom cap 80 has the dual function of providing a means for effectively effecting penetration of the casing 18 while prohibiting ingress of the matrix into the casing 18.

FIG. 14 illustrates an alternative embodiment of the end construction of casing 18. This is an alternative to the construction illustrated, for example, in FIG. 8. In the construction of FIG. 14, the casing or tube 18 includes an annular or circular rim 86 which preferably includes a lower beveled edge 88 and an upper beveled edge 90 to facilitate movement of the casing end 18 and ring 86 into and out of the soil. The ring 86 may be used in combination with an internal annular ring or member 44 of the type depicted in FIG. 7 or in place of such an annular ring or member 44.

Figure 15:
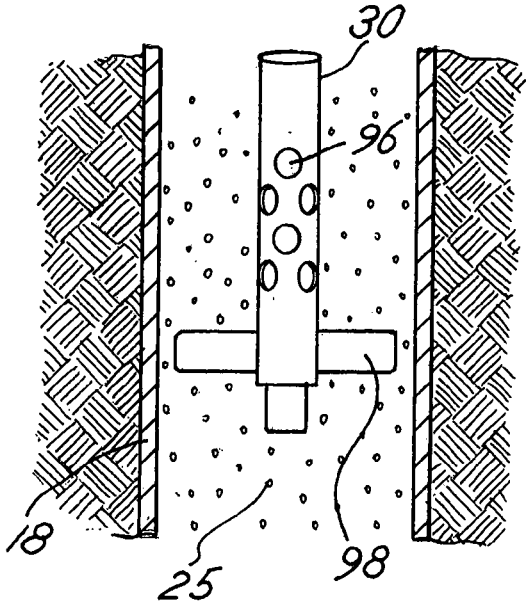
FIG. 15 is an enlarged cross sectional view of an alternative method for practice of the invention.

FIG. 15 illustrates yet another method feature of the invention as an alternative. Specifically, the insert element 30 (or the auger 50) may be utilized to provide insertion of mix materials into the casing 18 as the various lifts formed by the casing 18 are sequentially created. That is, the element 30 (or the auger 50) may include exit passages 96 and mixing blades 98. The exit passages 96 permit the insertion of a soil mixing compound such as lime or cement into the material forming the lifts. The blades 98 effect a mixing action upon vibration, rotation, or other movement of the insert element 30. Thus, the material forming the lifts may be mixed in situ. Various additives may be included. The additives may be varied with respect to each of the separately formed lifts.

It is possible to vary the construction and method of operation of the invention without departing from the spirit and scope thereof. Alternative hollow tube apparatus configurations, sizes and lengths of piers may be utilized. The element 30 may be varied in its configuration and use. It is also an optional element and may or may not be used depending on the type of aggregate used and other factors. Therefore, the invention is to be limited only by the following claims and equivalents thereof.

What is claimed is:

1. A method for installation of a pier in a soil matrix comprising, in combination, the steps of:

a) positioning a hollow tube having a longitudinal dimension and a lateral dimension in a soil matrix, said hollow tube including a hollow core and an open lower end, said hollow tube core being thereby filled with said soil matrix;

b) removing the soil matrix from within the hollow core;

c) inserting aggregate materials into the hollow core;

d) moving the hollow tube an incremental step from the soil matrix and simultaneously imparting lateral forces and longitudinal forces on the aggregate materials discharged from the open end of the hollow tube by such hollow tube movement to thereby form a compacted lift as the hollow tube is removed in said incremental step from the soil matrix;

e) placing a separate mechanical member in the hollow core extending longitudinally in the hollow tube and moving the mechanical member longitudinally and laterally to effect compaction of the aggregate materials discharged from the hollow core; and f) repeating step c), d) and e).

2. The method of claim 1 wherein the hollow tube apparatus is formed with an inwardly beveled lower edge end.

3. The method of claim 1 wherein the hollow tube apparatus includes a mechanical portion with a lower peripheral surface defining an angle intermediate the longitudinal and lateral directions.

4. The method of claim 1 including wherein the step of imparting forces includes vibrating the hollow tube apparatus.

5. The method of claim 1 wherein the hollow tube apparatus is cylindrical.

6. The method of claim 1 wherein the hollow tube apparatus includes a uniform diameter hollow core, and an internal rim at the bottom of the hollow tube beveled inwardly.

* * * * *